US007806373B2

(12) United States Patent
Zander

(10) Patent No.: US 7,806,373 B2
(45) **Date of Patent: *Oct. 5, 2010**

(54) COMBINATION MODEL TRAIN PROXIMITY DETECTOR AND SIGNAL

(76) Inventor: Dennis R. Zander, 35 Rolling Meadows, Penfield, NY (US) 14526

( * ) Notice: Subject to any disclaimer, the term of this patent is extended or adjusted under 35 U.S.C. 154(b) by 162 days.

This patent is subject to a terminal disclaimer.

(21) Appl. No.: 11/468,802

(22) Filed: Aug. 31, 2006

(65) Prior Publication Data

US 2007/0075191 A1 Apr. 5, 2007

Related U.S. Application Data

(63) Continuation of application No. 10/615,130, filed on Jul. 8, 2003, now Pat. No. 7,104,509, which is a continuation-in-part of application No. 09/826,654, filed on Apr. 5, 2001, now Pat. No. 6,600,429.

(51) Int. Cl.
*B61L 23/00* (2006.01)
*A63H 19/34* (2006.01)

(52) U.S. Cl. ..... 246/1 C; 246/473 A

(58) Field of Classification Search ..... 246/1 R, 246/1 C, 20, 21, 27, 28 R, 473 R, 477
See application file for complete search history.

(56) References Cited

U.S. PATENT DOCUMENTS 1,806,497 A 5/1931 Polak
2,096,894 A * 10/1937 Hall ..... 246/115
2,925,584 A * 2/1960 Bonanno ..... 246/473 A
3,163,125 A * 12/1964 Jenks ..... 246/479
3,752,426 A 8/1973 Pal
3,964,704 A 6/1976 Karr
4,064,508 A 12/1977 Simon
4,352,064 A 9/1982 Dunne
4,369,943 A 1/1983 Hussein
4,498,650 A 2/1985 Smith et al.
4,613,103 A 9/1986 Waranowitz
4,851,681 A * 7/1989 DePauli ..... 250/338.1
5,502,367 A 3/1996 Jones
5,864,304 A 1/1999 Gerszberg et al.
5,893,043 A * 4/1999 Moehlenbrink et al. ..... 701/207
6,014,934 A 1/2000 Pierson
6,025,789 A 2/2000 Lane et al.
6,241,197 B1 * 6/2001 Harland ..... 246/293

(Continued)

*Primary Examiner*—S. Joseph Morano
*Assistant Examiner*—Robert J McCarry, Jr.
(74) *Attorney, Agent, or Firm*—Harter Secrest & Emery LLP; Stephen B. Salai

(57) ABSTRACT

A combination model train sensor and signal includes a train proximity sensor, a signal such as red yellow and green signal lights, semaphores, wig-wag signals and the like together with a controller connected to the proximity sensor and the signal and the controller activates the signal appropriately when the proximity sensor indicates the absence of a train, and when the train proximity sensor indicates the presence of a train. A light source, preferably an infrared light source, and a light detector, preferably an infrared light detector, are arranged to reflect and detect from a passing train to indicate its presence. An output connected to the train proximity sensor for producing an output signal when the sensor indicates the presence of a train, which output can be used for controlling a remote signal. An input, responsive to a signal received from a remote sensor, controls the signal and synchronizes two signals.

13 Claims, 12 Drawing Sheets

U.S. PATENT DOCUMENTS 6,296,208 B1 10/2001 Franke
6,320,346 B1 11/2001 Graf
6,600,429 B2 * 7/2003 Zander ..... 340/917
7,183,943 B2 * 2/2007 Amemiya ..... 340/908

* cited by examiner

COMBINATION MODEL TRAIN PROXIMITY DETECTOR AND SIGNAL

CROSS-REFERENCE TO RELATED APPLICATIONS

This application is a continuation of U.S. application Ser. No. 10/615,130 filed Jul. 8, 2003, which is a continuation-in-part of U.S. application Ser. No. 09/826,654 filed Apr. 5, 2001 (Now U.S. Pat. No. 6,660,429).

STATEMENT REGARDING FEDERALLY SPONSORED RESEARCH OR DEVELOPMENT

Not Applicable

REFERENCE TO A "SEQUENCE LISTING"

Not Applicable

BACKGROUND OF THE INVENTION

This invention relates generally to accessories for toy or model railroad layouts and more particularly to an improved combination signal and train detector for such layouts.

There is a demand for model railroad accessories that simulate signals used on full sized railroads. Such accessories include block signals, semaphores, wig-wag signals and others. A block signal controls the passage of trains by providing a red or green signal to the engineer indicating whether it is safe to pass the block signal.

In full size trains, signals such as block signals semaphores and the like (collectively referred to herein for convenience as block signals) are controlled by a variety of complex mechanisms the precise duplication of which is not practical in model train layouts. This invention may be applied to signals that control the passage of trains, and to signals that control the passage of vehicular traffic at grade crossings. Accordingly, it has become common to provide block signals in model train layouts that turn red when a train approaches and turn green after the train has passed. Previously known block signals have been relatively simple devices that include a red light and a green light that can be selectively illuminated by applying appropriate activating signals to inputs of the block signal. The inputs to the block signals have come from a variety of sources generally referred to as train detectors. Known train detectors include detectors that use a section of isolated track that is responsive to a train passing over it and light or magnetic sensors to detect the presence of a passing train.

FIELD OF INVENTION

Heretofore, providing block signals responsive to the passage of trains has required the use of multiple devices and sometimes complex wiring connections between them.

It is an object of this invention to provide a combination of a block signal and train detector that greatly simplifies installation compared with known approaches.

It is another object if this invention to provide a combination block signal and train detector that can be easily synchronized with similar devices positioned at remote locations on a model train layout.

It is another object of the invention to provide a combination block signal and train detector that uses simple inexpensive circuitry that allows the device to be manufactured and sold at reasonable prices

BRIEF SUMMARY OF THE INVENTION

Briefly stated, and in accordance with one embodiment of the invention, a combination model train sensor and block signal includes a train proximity sensor, a red signal light, a green signal light, and a controller connected to the proximity sensor and the red and green signal lights. The controller turns on the green signal light and turns off the red signal light when the proximity sensor indicates the absence of a train, and turns on the red signal light and turning off the green signal light when the train proximity sensor indicates the presence of a train.

In accordance with another aspect of the invention, a combination model train sensor and signal includes a train proximity sensor, a safe to proceed signal and a stop signal connected to a controller as just described in which the controller activates the safe to proceed signal and deactivates the stop signal when the proximity sensor indicates the absence of a train and activates the stop signal and deactivates the safe to proceed signal when the train proximity sensor indicates the presence of a train.

In accordance with another aspect of the invention, the signal is a wigwag or swinging banjo signal.

In accordance with another aspect of the invention, the signal is a semaphore signal.

In accordance with another aspect of the invention, the signal is a target signal.

In accordance with another aspect of the invention, the train proximity sensor of the model train sensor and signal includes a light source, preferably an infrared light source, and a light detector, preferably an infrared light detector, arranged to reflect and detect from a passing train to indicate its presence.

In accordance with another aspect of the invention, the combination model train sensor and signal includes an output connected to the train proximity sensor for producing an output signal when the sensor indicates the presence of a train, which output can be used for controlling a remote block signal.

In accordance with another aspect of the invention, the combination model train sensor and signal includes an input, responsive to a signal received from a remote sensor, for controlling the illumination of the red and green lights and synchronizing two block signals.

In accordance with another aspect of the invention, the combination model train sensor and signal includes a combination input/output connected to the controller, the input/output producing a train present signal when the train proximity sensor indicates the presence of a train and being responsive to an externally applied train present signal for turning the red light on and the green light off even when the local train proximity sensor indicates the absence of a train.

In accordance with another aspect of the invention, the combination model train sensor and signal includes a first transistor switch for turning on the green light, the first transistor switch preferably connected to be normally on and a second transistor switch having an input connected to the train proximity sensor and an output connected to the red signal light and to an input of the first transistor switch to turn the red signal light on and apply an off signal to the input of the first transistor switch to turn the green signal off. The second transistor switch is preferably connected to be normally off.

In accordance with another aspect of the invention, the input/output is connected to the second transistor switch.

BRIEF DESCRIPTION OF THE SEVERAL VIEWS OF THE DRAWING(S)

The novel aspects of the invention are set forth with particularity in the appended claims. The invention itself together with further objects and advantages thereof may be more readily understood by reference to the following detailed description of a presently preferred embodiment of the invention taken in conjunction with the accompanying drawing in which:

DETAILED DESCRIPTION THE OF THE INVENTION

Figure 1:
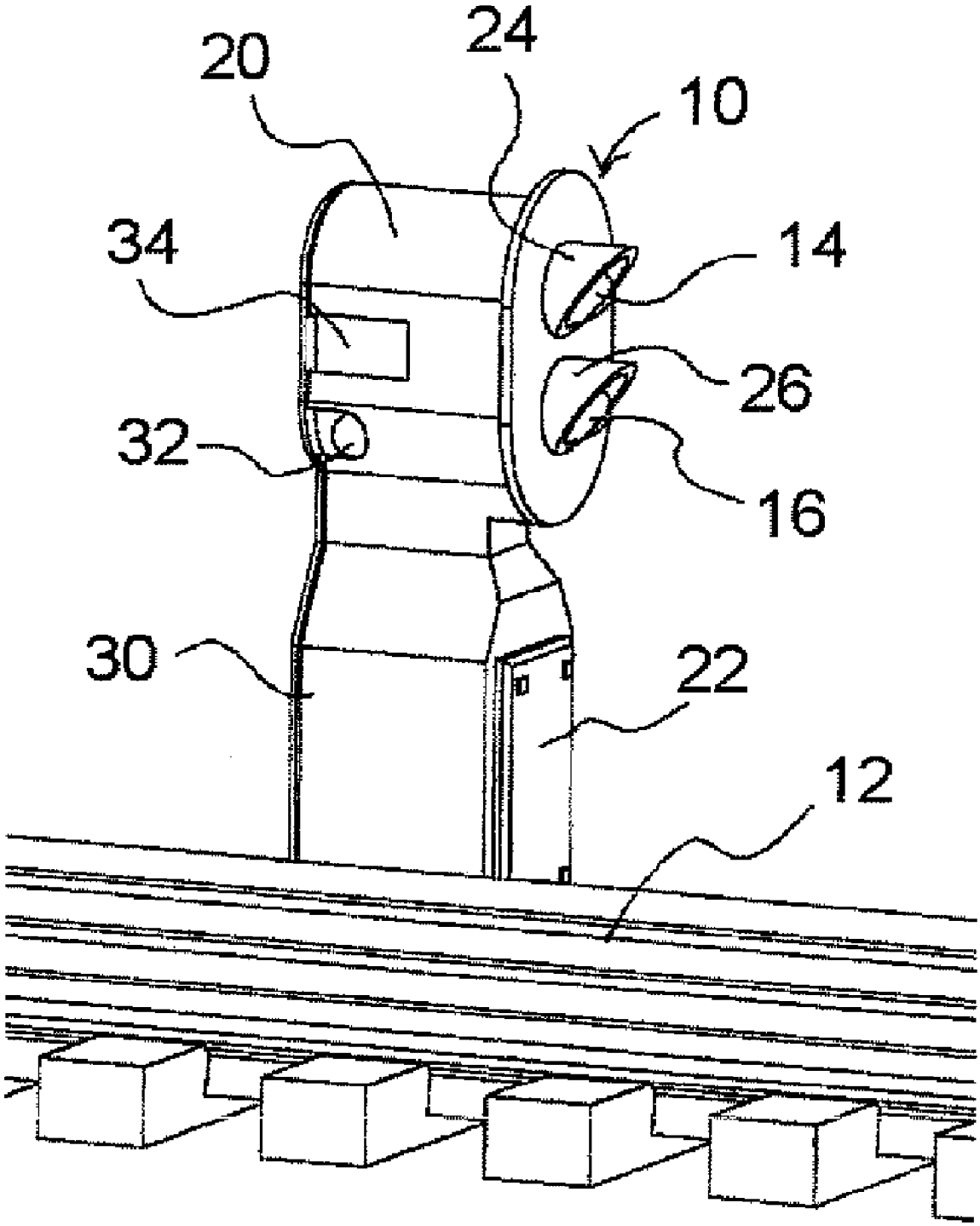
FIG. 1 is a diagrammatic view of a combination model train sensor and block signal disposed at a track side location.

Referring now to FIG. 1, a combination model railroad detector and block signal in accordance with this invention is illustrated in a diagrammatic form. For convenience, we will refer to the combination model train sensor and block signal as a block signal detector even though that language is slightly incongruous. The block signal detector indicated generally at 10 is positioned closely adjacent a section of a model railroad track 12. Preferably, the signal is positioned within in about ½" of the track to ensure reliable train detection.

The block signal detector 10 includes a red signal light 14 and a green signal light 16 arranged in the upper portion of a housing 20 that is configured to look like an actual block signal, of the type used on a full sized railroad. To that end, a simulated access door 22 is provided in the lower portion of the signal and the signal lights 14 and 16 are arranged in a conventional top and bottom configuration. Preferably, light hoods 24 and 26 surround the lights to make the signal lights visible in bright sun. Preferably, the block signal detector is formed of relatively high impact plastic to provide a durable but low cost construction. The plastic housing can be injection molded to produce a pleasing appearance at low cost. The internal components of the housing are mounted on a printed circuit board that is actually accessed through a rear cover plate 30 rather than simulated access door 22.

Preferably, an infrared light source 32 is mounted on the printed circuit board (not visible in this figure) and extends through an opening in housing 20. A preferably infrared sensor 34 is mounted in relatively close proximity to infrared source 32 but the source and detector are arranged so that the detector is not responsive to light emitted directly from the source but is responsive only to a light reflected from a passing model train. An internal light barrier between the source and the detector may also be used.

Figure 2:
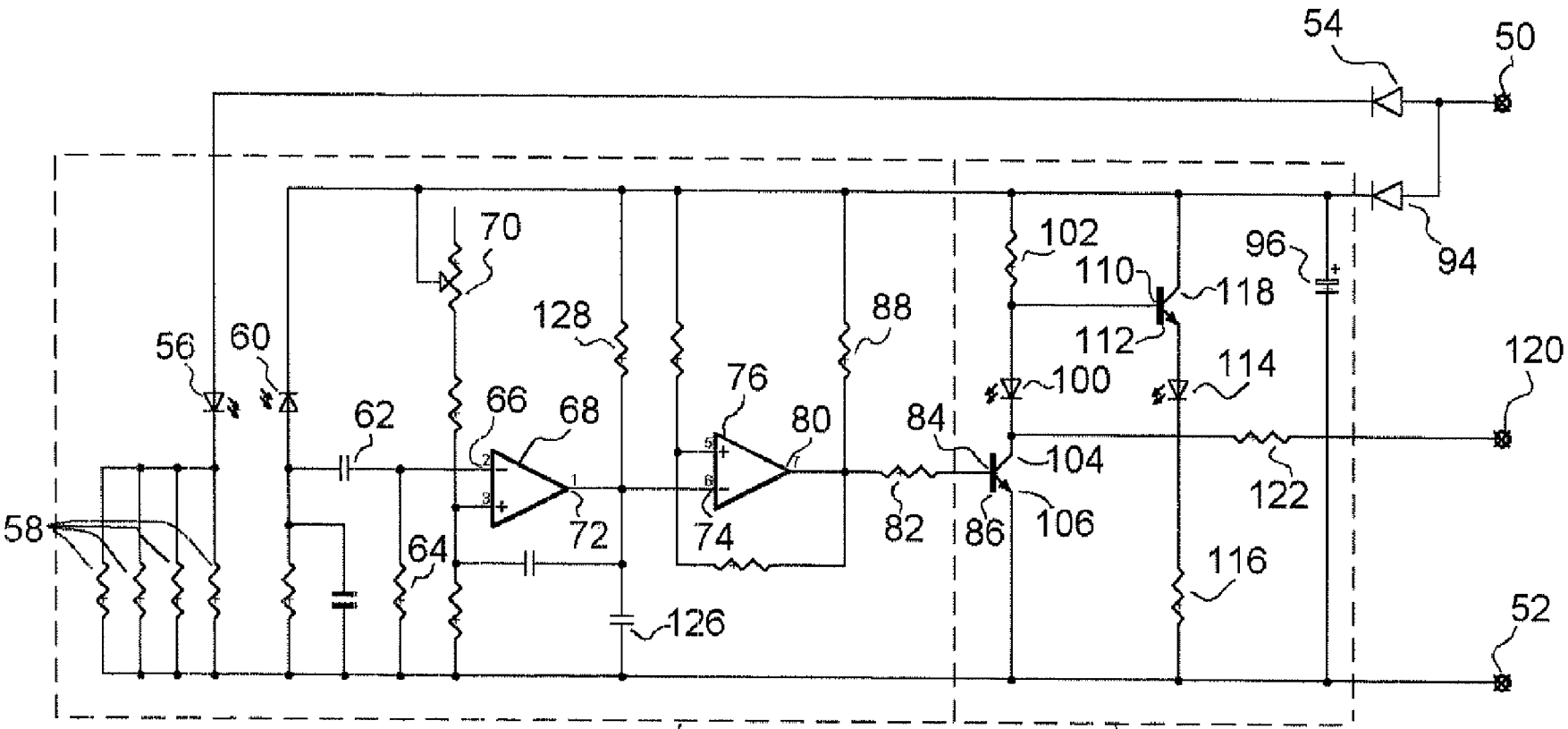
FIG. 2 is a schematic diagram of a combination model train detector and block signal in accordance with this invention.

The operation of the block signal detector will now be described in conjunction with the schematic diagram of a presently preferred embodiment of a controller therefor shown in FIG. 2.

The block signal detector circuitry is designed to be powered from a 12-14 volt AC source sometimes referred to as a transformers of the type used to provide power to the engines and accessories of model trains. Power input terminal 50 is adapted to be connected to the AC power source and a common terminal 52 which for convenience may be referred occasionally herein as a ground terminal even though is it is not in fact grounded, is adapted to be connected to the opposite side of the power source. A rectifier diode 54 is connected between the power input terminal 50 and a light emitting diode 56 which is preferably an infrared light emitting diode. Current limiting resistors 58 set the current through infrared emitting diode 56 to a level that balances long diode life with sufficient light output to reliably detect the presence of model trains.

the arrangement just described produces a stream of light pulses having a repetition rate of approximately 60 hertz from infrared emitting diode 56, rather than a constant beam. An infrared detector 60 is connected to an inverting input 66 of an operational amplifier 68. Operational amplifier 68 is preferably ½ of an LM393M dual operation amplifier. A high pass filter, including a capacitor 62 and a resistor 64 is connected between the output of infrared detector 60 and an input 66 of an amplifier 68 to substantially eliminate false triggering caused by constant ambient light. This permits the sensitivity of operational amplifier 68 to be set relatively high for reliable train detection without increasing false triggering from ambient light. The sensitivity of the operational amplifier 68 is set by a variable resistor 70. The remaining components associated with operational amplifier 68 are conventional and will be readily understood by those skilled in the art.

An output 72 of an amplifier 68 is connected to an inverting input 74 of a second operational amplifier 76 configured as an inverter to correct the sense of the output signal for operating the controller of the block signal detector. The output terminal 80 of the amplifier 76 is connected through a resistor 82 to the base 84 of a transistor 86. Base 84 is normally held high by resistors 88 and 82 so that the transistor is normally on. Output 80 pulls base 84 essentially to ground through resistor 82 when a train is present as indicated by the presence of reflected infrared light at detector 60. The portion of the block signal detector just described is indicated in phantom lines in FIG. 2 as train proximity detector 90. The remaining portion of the circuit, indicated in phantom as 92, is referred to as the controller. A second rectifier diode 94 provides power to controller 92 and proximitor sensor 90. A filter capacitor 96 smoothes the output of rectifier diode 94 to provide relatively steady DC output for the red and green signal lights.

Referring back to FIG. 2, a red signal light 100, preferably a red light emitting diode, is connected in series with a collector load resistor 102 between a collector 104 of transistor 86 and the positive voltage source. An emitter 106 of transistor 86 is connected to common. Normally, transistor 86 is held off by inverter amplifier 76 and red light emitting diode 100 is extinguished. As long as transistor 86 is off, base 10 of transistor 112 is held high by resistor 102 thereby turning transistor 112 on and allowing current to flow through the green signal light 114 which is preferably a green light emitting diode, and then through a collector resistor 116 which sets the current through a light emitting diode 114. The collector 118 of transistor 112 is connected to the positive voltage source.

When a train is detected, the signal applied to the base 84 of transistor 86 goes high turning transistor 86 on. The voltage at base 110 of transistor 112 is pulled low to a voltage of approximately equal to the saturation voltage of transistor 86 plus the voltage drop of light emitting diode 100, the sum of which is approximately 1.7 volt which turns transistor 112 off and extinguishes light emitting diode 114.

In accordance with a presently preferred embodiment of the invention a time delay is provided so that the red signal lamp remains illuminated and the green signal lamp remains extinguished for a pre-selected time after the proximity detector has detected the passage of a train. Time delay capacitor 126 is connected the output 72 of amplifier 68 and ground. The time constant of capacitor 126 and resistor 128 connected in series therewith, sets the predetermined time. Preferably, a time of about 2 seconds is provided.

In accordance with the preferred embodiment of the invention, an input/output terminal 20 is provided. Input/output terminal 120 is connected to collector 104 of transistor 86 through a small isolation resistor 122. It will be appreciated that when a train is detected by the proximity detector 90 and transistor 86 is turned on, the input/output terminal 120 is pulled low through resistor 122. When no train is present and transistor 86 is off, the input/output terminal 120 is high.

If a low or ground remote signal is connected to input/output terminal 120 it will be appreciated that the collector 104 of transistor 86 will be pulled low whether transistor 86 is turned on or off by proximity detector 90. Since transistor 86 is normally off in the absence of a train, it will be seen that a remote train present signal applied to input/output terminal 120 will turn red signal light 100 on and turn green signal light 114 off. This allows two block signal detectors in accordance with the invention to be synchronized so that when one detects the presence of a train, the light in the other will also turn from green to red. The synchronization is bi-directional and the wiring is exceeding simple as will be seen by reference to FIG. 3.

Figure 3:
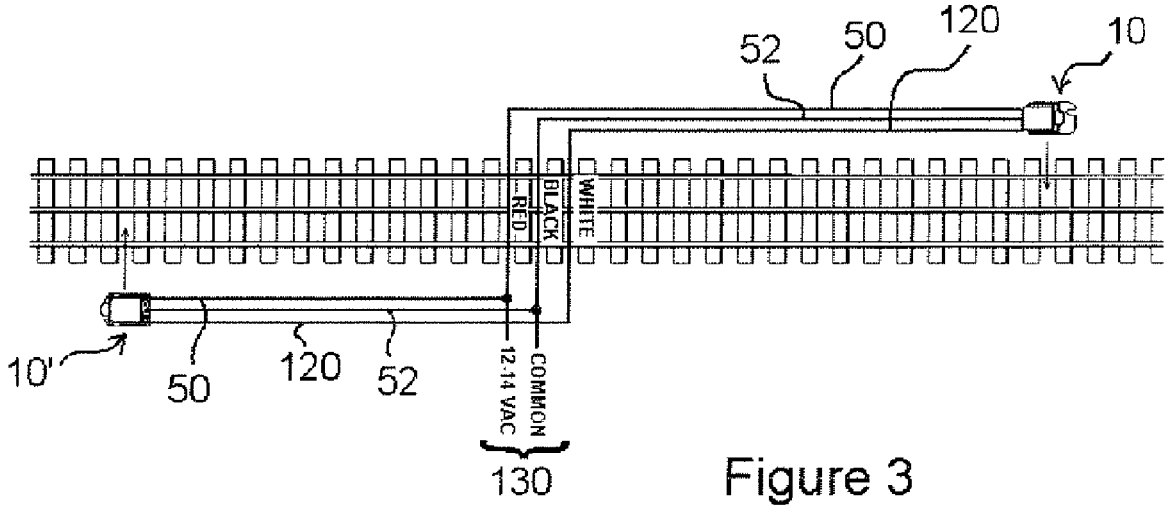
FIG. 3 is a diagrammatic view showing two combination model train detectors and block signals connected together for synchronized operation in accordance with the invention.

FIG. 3 shows a pair of block signal detectors 10 and 10' interconnected for synchronized operation. Terminals 50, 52 and 120 of first block signal detector 10 are connected to the like numbered terminals of the second block signal detector 10'. A power source of 12-14 volts AC is connected between terminals 50 and 52 of the two block signal detectors respectively as shown at 130. It will appreciated that if for example a train approaches from the left as the Figure would normally be viewed, block signal detector 10' will detect the proximity of the train and the red signal lamp will be illuminated and the green signal lamp extinguished. Simultaneously, input/output 120 of block signal 10 will be driven low thereby illuminating the red signal lamp and extinguishing the green signal lamp of block signal detector 10 even though no train is detected by the proximity detector of block signal detector 10. Similarly, if a train approaches from the right, the detectors in block signal detector 10 will sense the proximity of the train and illuminate the red signal light and extinguish the green signal light of both of the block signal detectors 10 and 10'.

Figure 4:
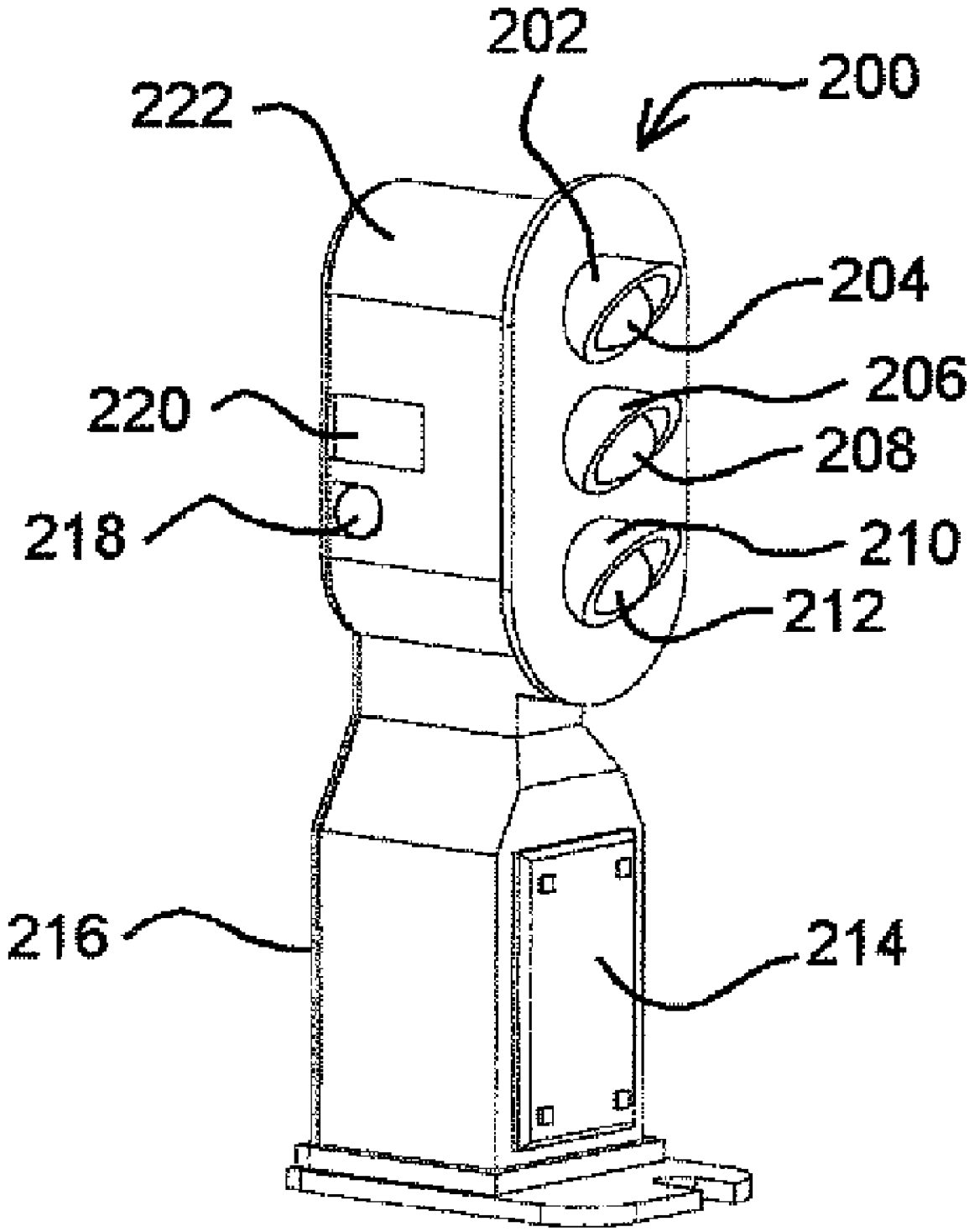
FIG. 4 is a diagrammatic view of a combination model train sensor and a block signal having three signal lights in accordance with another embodiment of the invention.

FIG. 4 is a diagrammatic view of a combination model railroad detector and block signal in accordance with another aspect of this invention. The block signal detector 200 includes a red signal light 204, a yellow signal light 208, and a green signal light 212. A simulated access door 214 is provided in the lower portion of the signal and the signal lights 204, 208 and 212 are arranged in conventional top to bottom configuration in the upper portion. Preferably, light hoods 202, 206 and 210 surround or cover the top portions of the lights to make the light signals visible in bright sun. Preferably, like the block signal shown in FIG. 1, the block signal detector shown in FIG. 4 is formed of a relatively high-impact plastic to provide a durable but low cost construction. The internal components of the block signal and sensor are preferably mounted on a printed circuit board that is accessed through a rear cover plate 216, rather than the simulated access door 20.

Preferably, an infrared light source 218 is mounted on the printed circuit board (not shown) and extends through an opening in a housing 222. A preferably infrared sensor 220 is mounted in relatively close proximity to infrared source 218, but the source and detector are arranged so that the detector is not responsive to light emitted directly from the source but is responsive only to light reflected from a passing model train. An internal light barrier between the source and the detector may be used if desired.

A controller for the combination model train sensor and simulated block detector of FIG. 4 is shown in 15 and will be described after describing a number of other signals in accordance with the invention, all of which may be controlled by the same or a similar controller.

Figure 5:
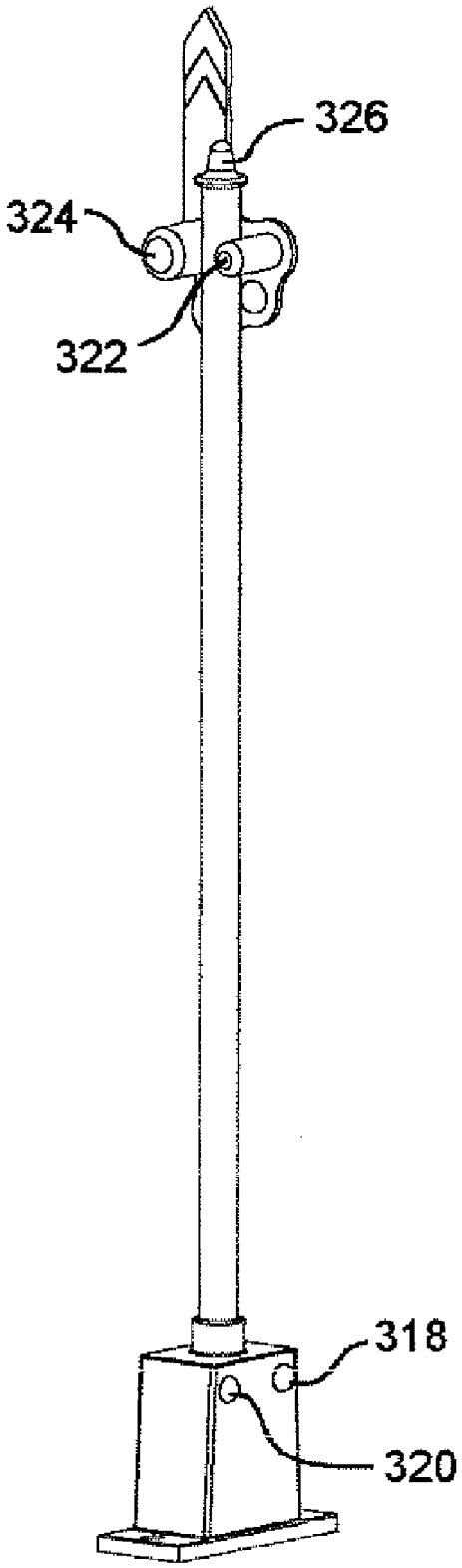
FIG. 5 is a rear prospective view of a model train sensor and semaphore signal in accordance with the invention.

FIG. 5 shows a combination model railroad detector and a semaphore signal in accordance with the invention. The semaphore signal 300 includes a base on which an infrared light source 318 and an infrared detector 320 are mounted. In each of the signals shown in the following figures, the light source and detector are mounted and isolated as described in connection with FIGS. 1 and 4. The semaphore signal itself is mounted on the upper portion of supporting pole 304. A movable semaphore signal blade 310 is mounted on a shaft 308 of an actuator 324. Semaphore blade 310 is movable among safe to proceed, caution, and stop positions, as shown and described in more detail in connection with FIGS. 7-9. Actuator 324 may be a small motor, a rotary solenoid actuator or the like capable of positioning the semaphore signal blade at the three principal positions.

A light source 322 is mounted on support 304 and projects a light beam through light filters 312, 314 and 316, respectively, in the three positions of the semaphore signal. Preferably, light filter 316 produces a green light, light filter 314 produces a yellow light, and light filter 312 produces a red light. In this way, only a single light source 322 is required to provide three different colored simulated signals.

Figure 7:
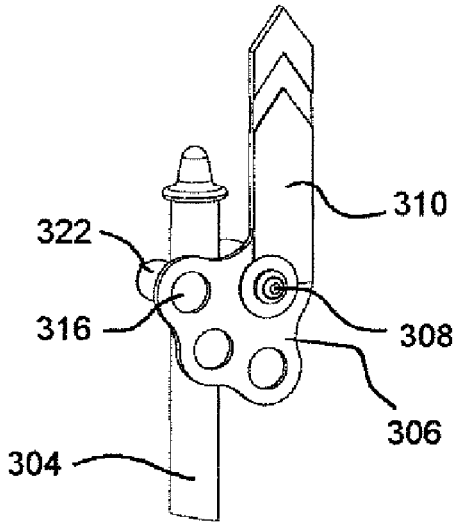
FIG. 7 is an enlarged partial view of the signal portion of the semaphore signal of FIGS. 5 and 6 shown in a safe to proceed position.

FIG. 7 shows the semaphore signal in the safe to proceed position. The semaphore blade 310 is vertical and green filter 316 is positioned in front of light source 322.

Figure 8:
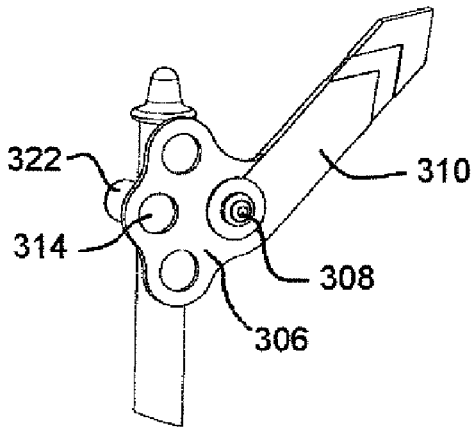
FIG. 8 is an enlarged partial view of the semaphore signal of FIG. 7 shown in a caution position.

FIG. 8 shows the semaphore signal in the caution position. Blade 310 is positioned at approximately a 45 degree angle and yellow light filter 314 is positioned in front of light switch 322.

Figure 9:
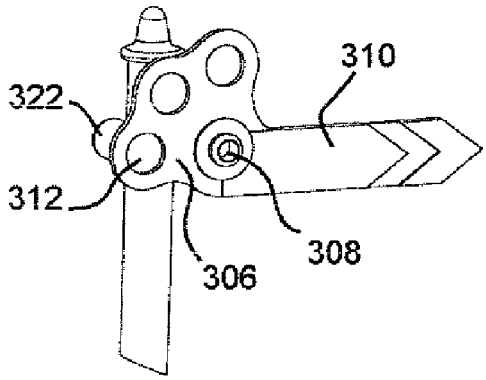
FIG. 9 is an enlarged partial view of the semaphore signal of FIGS. 1 and 6 in a stop position.

FIG. 9 shows the semaphore signal in the stop configuration. Semaphore blade 310 is oriented horizontally and the red light filter 312 is positioned in front of light source 322.

Preferably, the semaphore blade 310 and the filter holder portion 306 extending from the blade on the opposite side of the pivot from the blade are fabricated from a high impact plastic or the like which may be molded to provide a durable but low cost construction.

Figure 6:
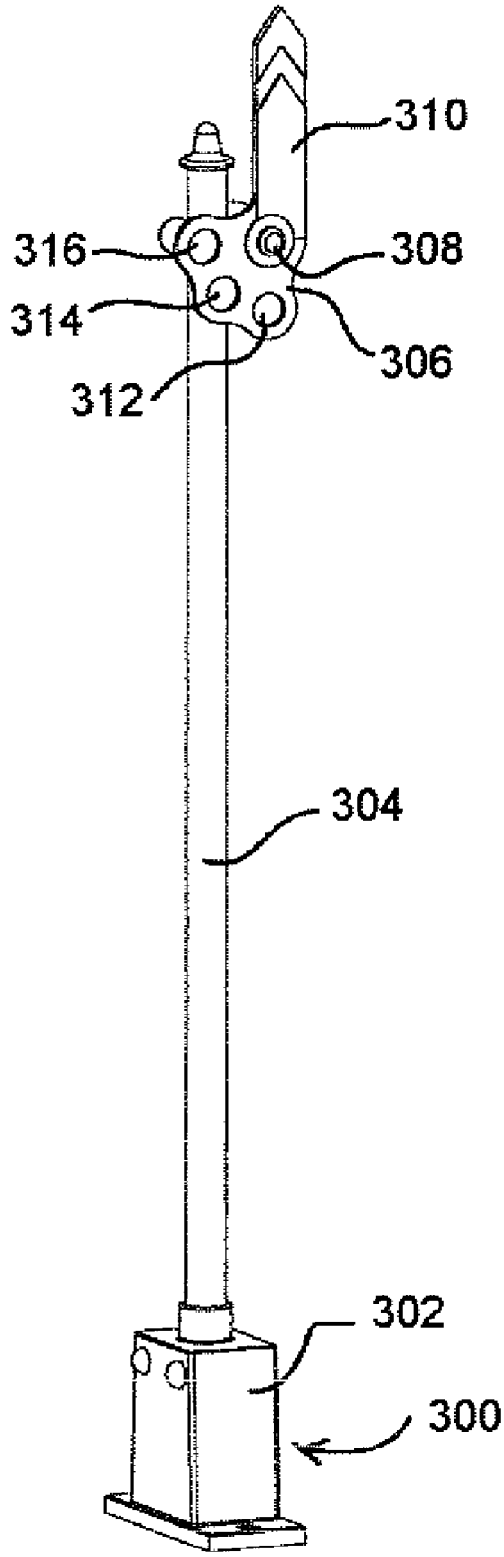
FIG. 6 is a front perspective view of the semaphore signal of FIG. 5 in accordance with the invention.
Figure 10:
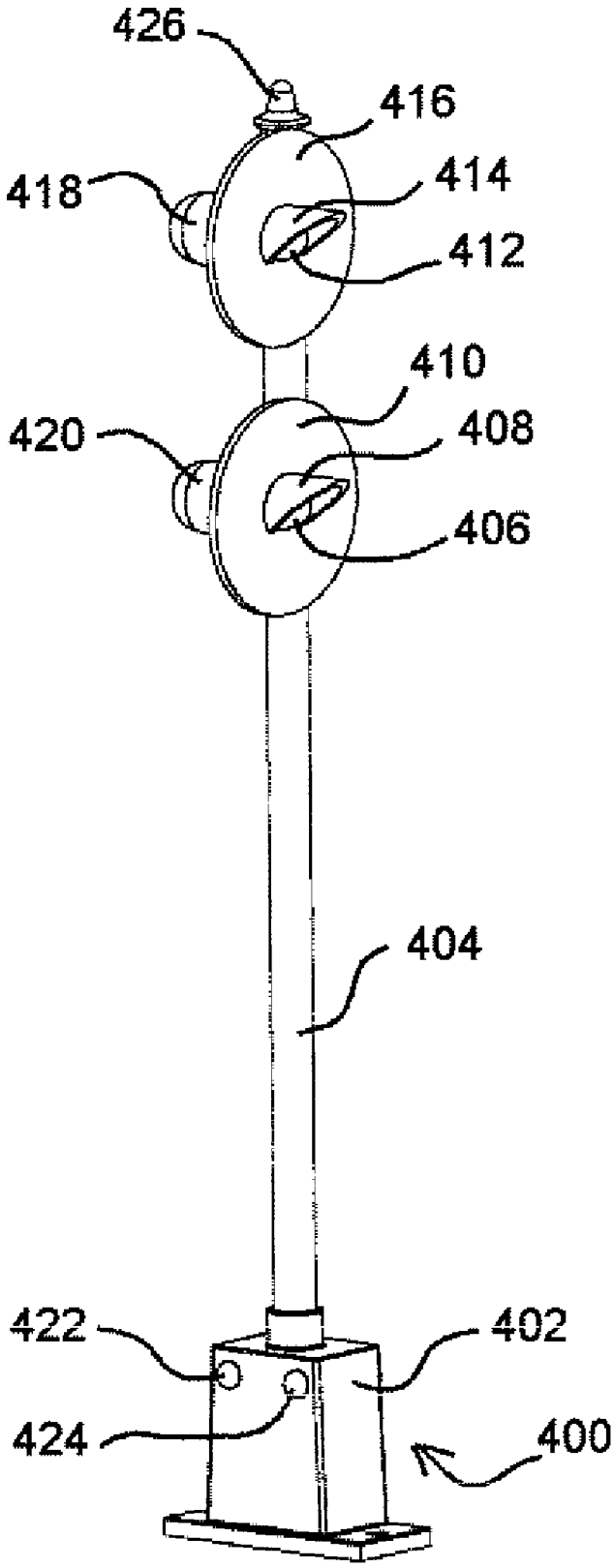
FIG. 10 is a front prospective view of a model train sensor and target signal having two signal lights in accordance with the invention.
Figure 11:
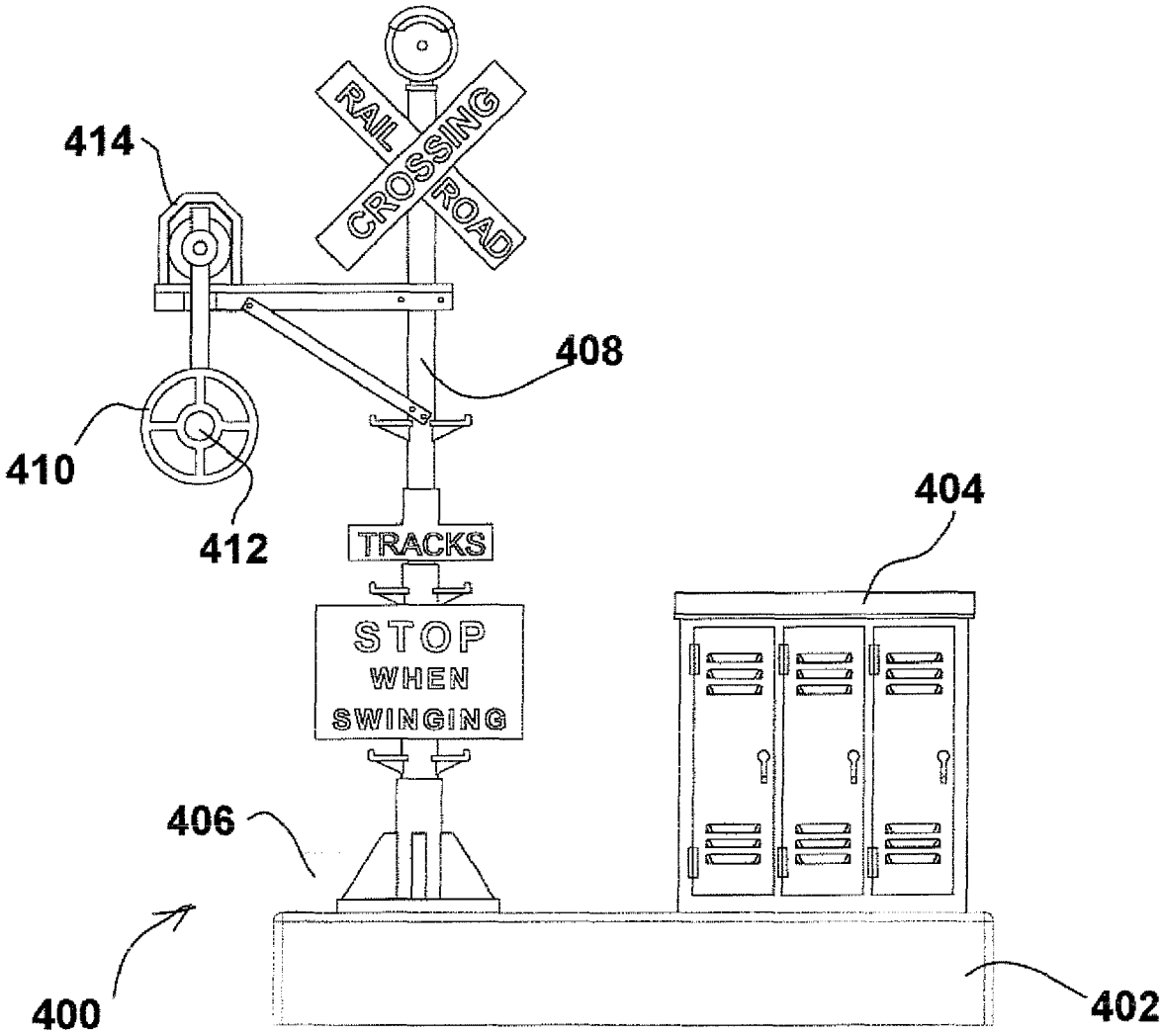
FIG. 11 is a front elevation of a model train sensor and wigwag or banjo signal in accordance with this invention.

FIG. 10 shows a two-light, target signal in accordance with this invention. The target signal includes a base 400 that is quite similar to the base of the semaphore signal shown in FIGS. 5 and 6. A light source 422 and a light detector, preferably an infra red detector 424, are positioned in the base and arranged to be oriented facing a track along which a model train moves. A simulated access door 402 may be provided and an actual access door is preferably provided for gaining access to the internal components of the combination sensor/signal much in the manner of FIGS. 1 and 5.

An elongated vertical column 404 supports one or more target signals of which two, signals 410 and 416, are shown in FIG. 10. Preferably, target signal 416 is a red stop signal and target signal 410 is a green safe to proceed signal.

Stop signal 416 includes a preferably red light 412 and a light hood 414. Safe to proceed signal 410 includes a preferably green light 406 and a light hood 408. Housings 418 and 420 contain the light sources, which may be a conventional incandescent or LED lamp. The electrical connections to which are entrained through support 404 into base 400.

FIGS. 11 through 14 show a wigwag or banjo signal in accordance with this invention. Banjo signal 400 includes a base 402 and a simulated equipment cabinet 404. An electrical circuit board, preferably a printed circuit board, that includes the electrical components of the signal and sensor may be mounted in cabinet 404 or in base 402. As will be described in more detail below, an electrical motor for actuating the wigwag signal may also be mounted in base 402. The wigwag signal includes a vertical support 406 having simulated signage thereon extending to an upper portion 408 on which a conventional railroad crossbuck is mounted. The wigwag signal is attached to the supporting column between the signage and the crossbuck and includes a cantilevered arm with a diagonally arranged supporting arm carrying an actuator 414 and a movable banjo signal 410. Preferably, a selectively illuminated red signal light 412 is mounted in the middle of the banjo signal.

Figure 12:
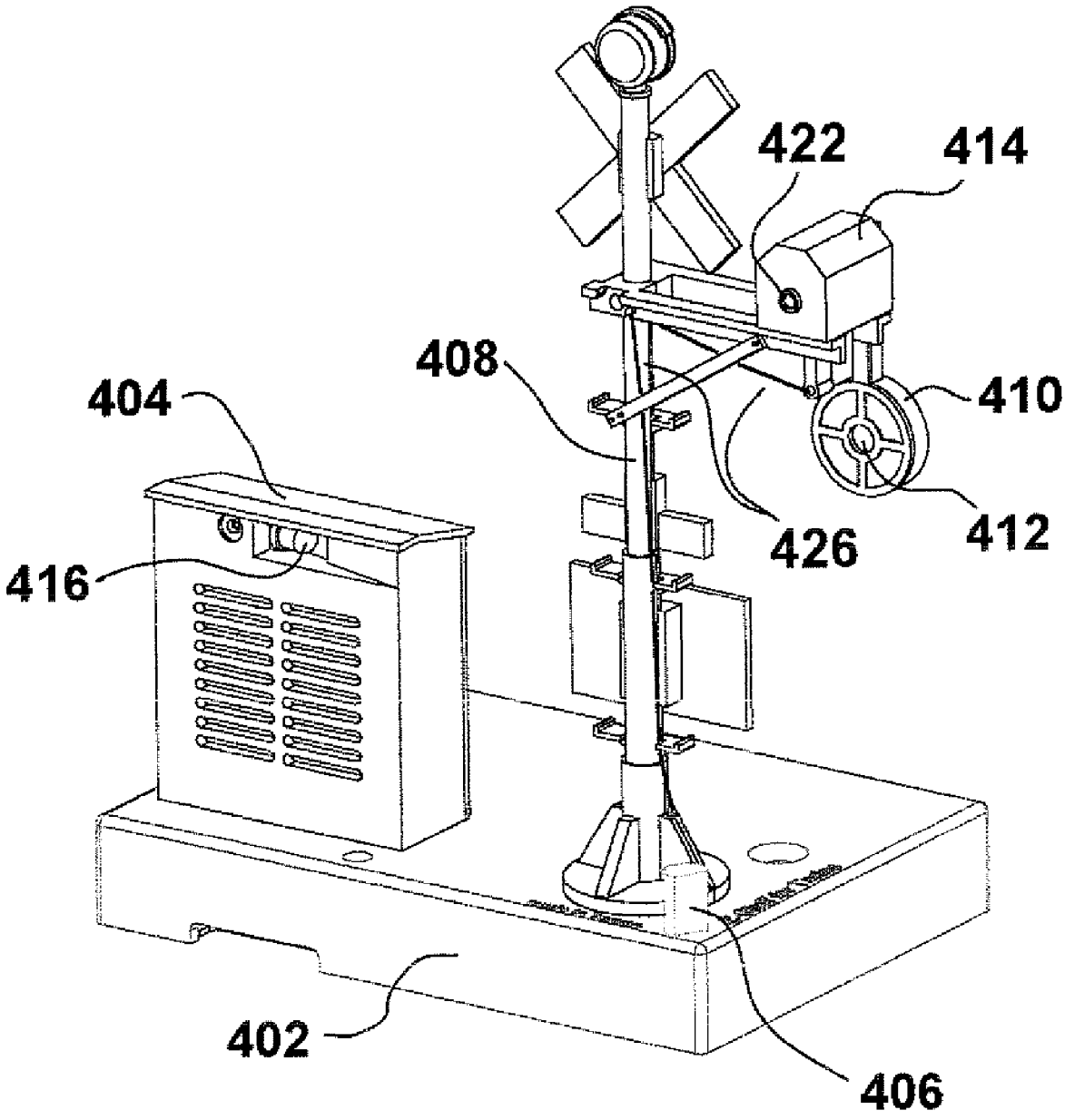
FIG. 12 is a rear prospective view of the wigwag signal of FIG. 11.

As shown in FIG. 12, the simulated equipment housing includes an opening through which an infrared light source 416 can be seen. Light source 416 is arranged to project light such as infrared light down the track in a direction toward the vertical support from the simulated equipment cabinet. An infrared detector 406 is mounted on the base of the wigwag detector to sense light reflected from an approaching train. Housing 414 includes a bushing through which a pivoted support rod for the wigwag signal is mounted. An actuating arm extends downwardly from the housing as will be shown in more detail in FIG. 14. An actuating string or the like is attached to the lower end of the actuating arm an entrained through various direction changing pulleys or openings into the base 402 of the wigwag signal where it is actuated by a motor, not shown.

Figure 13:
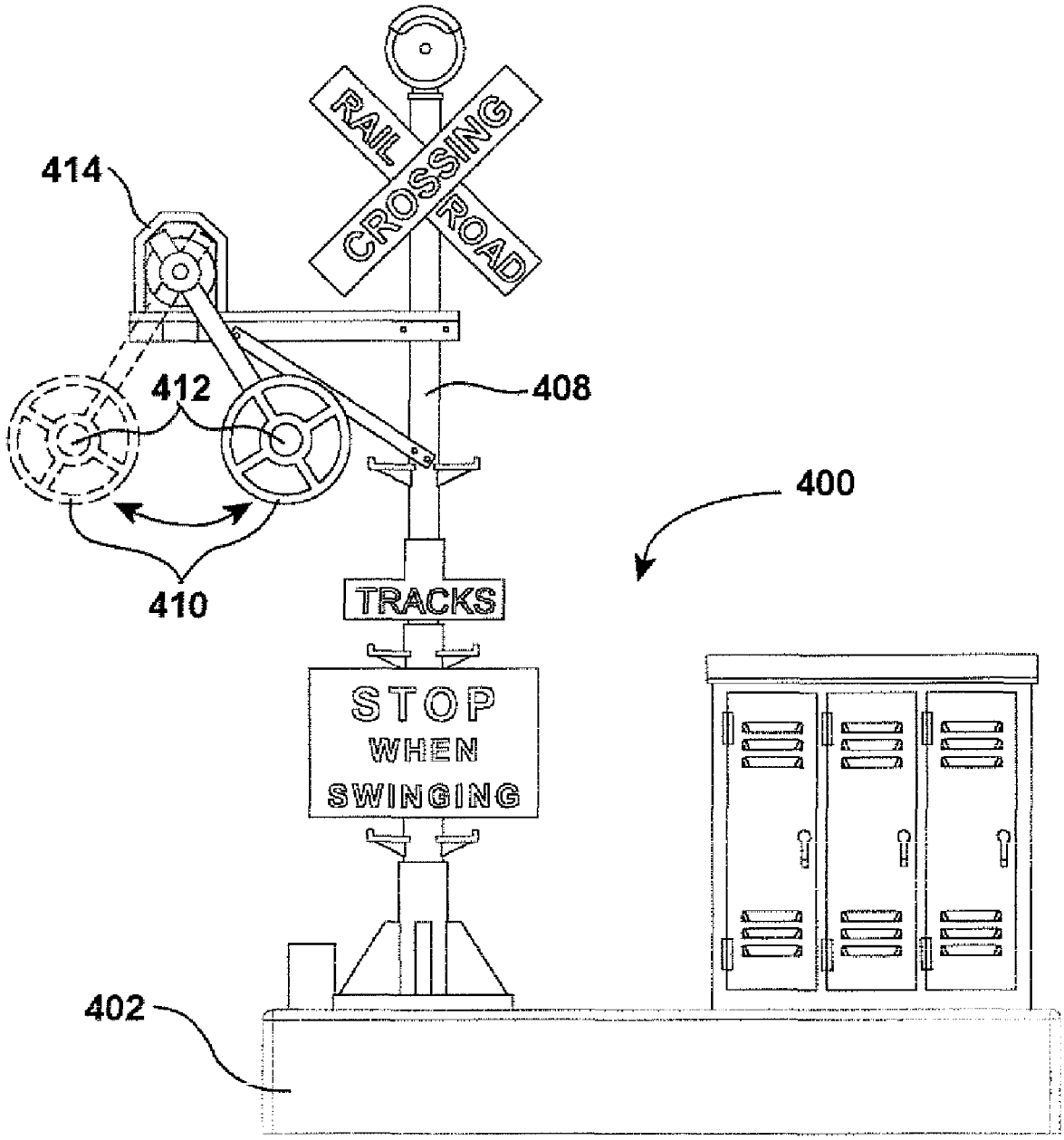
FIG. 13 is a front elevation of the wigwag signal of FIG. 11 showing the signal in the stop configuration.

FIG. 13 shows the wigwag signal in operation. The signal 410 moves left and right repeatedly and the light 412 is illuminated to simulate a stop or unsafe to proceed condition. The light source is extinguished and the wigwag signal stops in a more or less vertical position to signal a safe to proceed condition.

Figure 14:
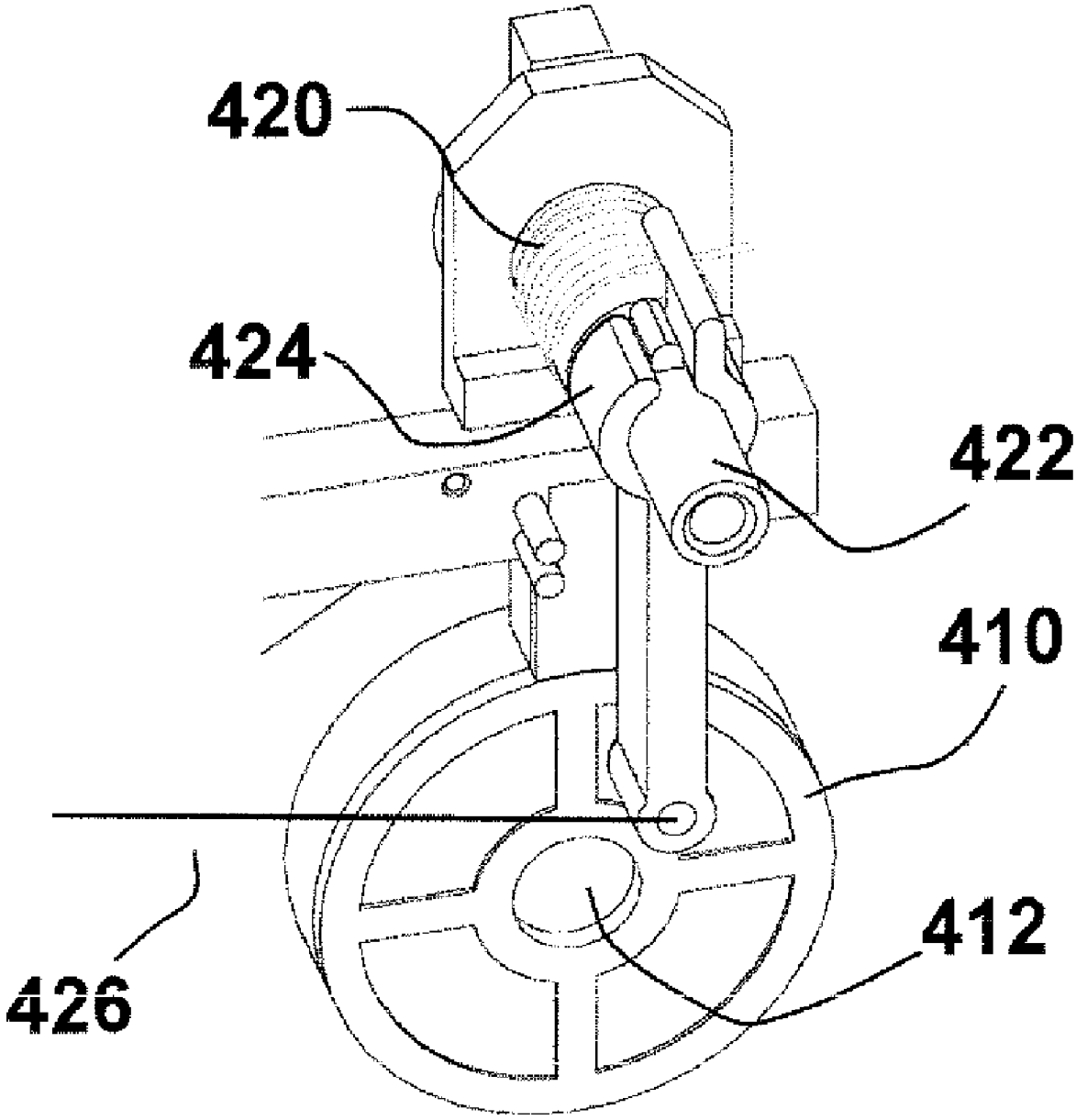
FIG. 14 is an enlarged view of an enlarged rear prospective view of an operating mechanism for the movable portion of the wigwag signal of FIG. 13.

As shown in FIG. 14, the pivotal support rod 422 extends through a mounting block on the top of the cantilever arm of the wigwag signal. A spring 420 biases the wigwag signal to the extreme left (right as shown in this figure) position from which it may be moved by string 426. When the wigwag signal is in the safe to proceed configuration, the string is tensioned to position the signal essentially vertically. The string is repeatedly tensioned and released to move the signal back and forth in the stop configuration.

Figure 15:
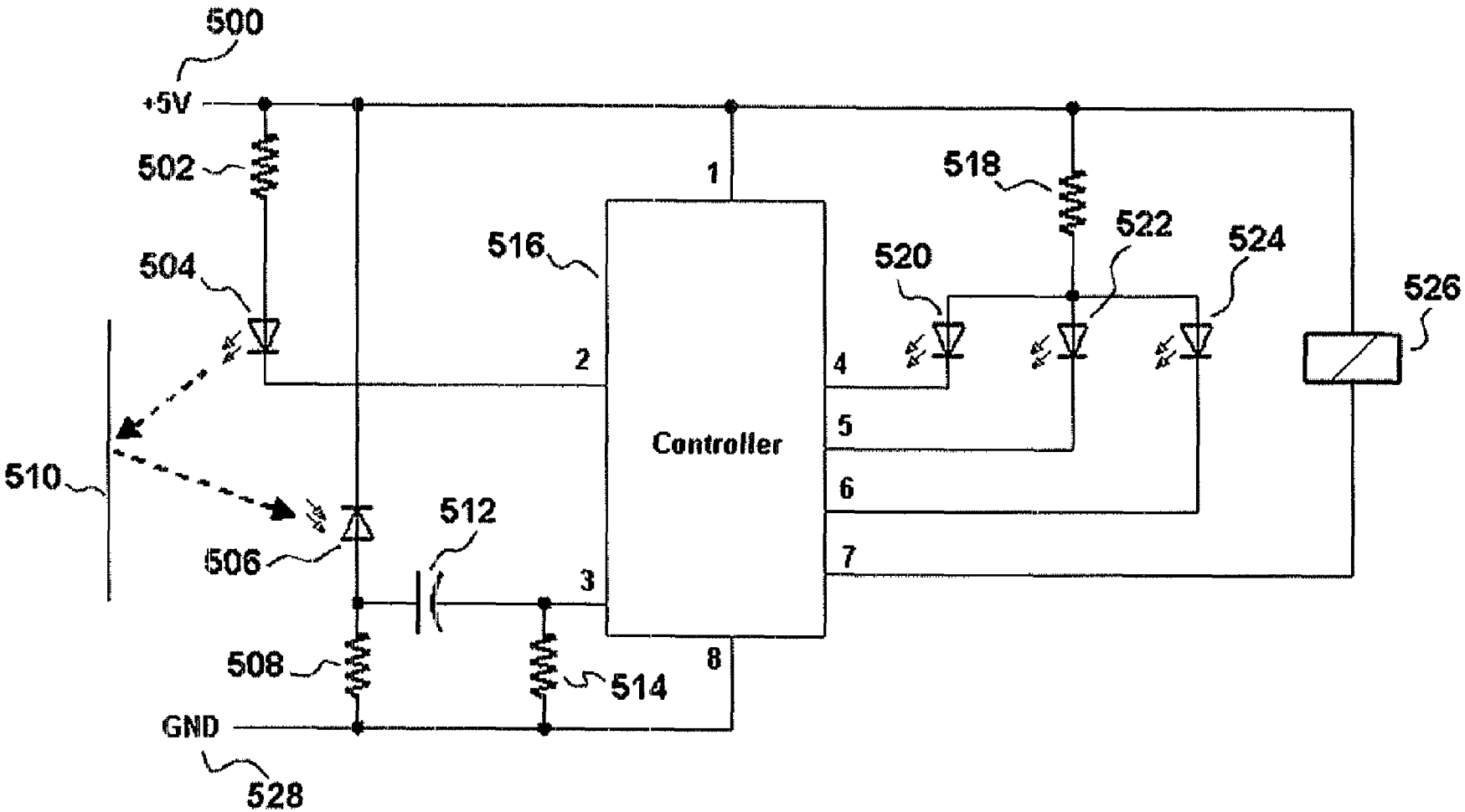
FIG. 15 is a block diagram schematic of controller for the three state signals of the invention.

A generalized controller for the combination model railroad sensors and signals in accordance with this invention is shown in FIG. 15. The controller 516 will be understood to be substantially similar to the controller shown in FIG. 2 except that three states are enabled for controlling three state and two state signals. An infrared source 504 is connected through a current limiting resistor 502 to a voltage supply such as a five-volt supply 500. The cathode of the infrared source, which is preferably an infrared light admitting diode is connected to terminal 2 of controller 516 for turning the infrared source on and off. Preferably, the source is pulsed as described above.

The light from the infrared source is reflected from a passing model railroad engine or car 510 and detected by infrared detector 506. Detector 506 is connected between the five-volt source 500 and ground 528 through a current limiting resistor 508. A low pass filter comprised of capacitor 512 and resistor 514 conditions the output of detector 506, which is applied to input 3 of controller 516. Terminal 8 of the controller is connected to ground in terminal 1 to the five-volt source. The controller has four outputs for selectively enabling thee visual output devices illustrated as a light emitting diodes 520, 522 and 524 which are preferably red, yellow, and green, respectively, all connected to the five-volt source 500 through a current limiting resistor 518. An actuator, indicated generally at 526, is connected to output 7 and to the five-volt source. The actuator 526 may be actuator 322 of the semaphore signal or the actuator for the wigwag signal shown in FIG. 13. The exact signal applied to the actuator 526 depends on the nature of the actuator and a programming of controller 516 to provide those signals is a matter of conventional design once guided by the disclosure of the signals as set forth herein.

While the invention has been described in connection with the presently preferred embodiment thereof, those skilled in the art will recognize that a number of modifications and changes may be made therein without departing from the true spirit and scope of the invention which accordingly is intended to be defined solely by the appended claims:

The invention claimed is:

1. A stand-alone combination model train sensor and model train signal comprising:

a housing;

a remote detecting, wireless, model train proximity sensor within the housing;

a model train red signal on the housing;

a model train green signal on the housing;

a controller connected to the remote detecting, wireless, model train proximity sensor, the model train red signal and the model train green signal, said controller activating the model train green signal for display and deactivating the model train red signal when the remote detecting, wireless, model train proximity sensor indicates the absence of a model train and activating the model train red signal for display and deactivating the model train green signal when the remote detecting, wireless, model train proximity sensor indicates the presence of a model train.

2. The combination model train sensor and signal of claim 1 comprising a model train yellow signal, and wherein the controller activates the model train yellow signal for display between the display of the model train green signal and the display of the model train red signal, but does not activate the model train yellow signal for display between the display of the model train red signal and the display of the model train green signal.

3. The combination model train sensor and model train signal of claim 1 comprising model train a signal light, and in which activating the model train red signal comprises positioning a red filter over the model train signal light and activating the model train green signal comprises positioning a green filter over the model train signal light.

4. The combination model train sensor and signal of claim 1 comprising a sensor that reflects a signal from a train.

5. The combination model train sensor and signal of claim 1 in which the sensor comprises an infrared sensor.

6. A stand-alone combination model train sensor and signal comprising:

a housing;

a remote detecting, wireless, model train proximity sensor within the housing;

a model train safe to proceed signal on the housing;

a model train stop signal on the housing;

controller connected to the remote detecting, wireless, model train proximity sensor, the model train safe to proceed signal and the model train stop signal, said controller displaying the stop signal and terminating the safe to proceed signal when the remote detecting, wireless, model train proximity sensor indicates the absence of a model train and displaying the stop signal and terminating the safe to proceed signal when the remote detecting, wireless, model train proximity sensor indicates the presence of a model train.

7. The combination model train sensor and model train signal of claim 6 in which the model train safe to proceed signal comprises a stationary banjo signal, and the model train stop signal comprises a swinging banjo signal.

8. The combination model train sensor and model train signal of claim 6 in which the model train safe to proceed signal comprises a semaphore oriented in a generally vertical orientation and the model train stop signal comprises a semaphore oriented in a generally horizontal orientation.

9. The combination model train sensor and model train signal of claim 8 in which the semaphore comprises a light source and a plurality of colored filters, and in which the model train safe to proceed signal comprises a green filter positioned over the light source and the model train stop signal comprises a red filter positioned over the light source.

10. The combination model train sensor and model train signal of claim 9 in which the filters are mounted on the semaphore and move into position over the light source as the semaphore moves between a vertical orientation and a horizontal orientation.

11. The combination model train sensor and model train signal of claim 6 in which the model train safe to proceed signal comprises a target signal having at least one light.

12. The combination model train sensor and signal of claim 6 comprising a sensor that reflects a signal from a train.

13. The combination model train sensor and signal of claim 6 in which the sensor comprises an infrared sensor.

* * * * *